United States Patent [19]

Laszlo

[11] 3,955,060

[45] May 4, 1976

[54] MICROWAVE OVEN CONSTRUCTION

[75] Inventor: Tibor S. Laszlo, Richmond, Va.

[73] Assignee: Philip Morris Incorporated, New York, N.Y.

[22] Filed: Aug. 14, 1974

[21] Appl. No.: 497,184

[52] U.S. Cl. ..... 219/10.55 D

[51] Int. Cl.[2] ..... H05B 9/06

[58] Field of Search ..... 219/10.55 D, 10.55 F, 219/10.55 R, 10.55 E; 174/35 GC, 35 MS, 35 R

[56] References Cited

UNITED STATES PATENTS

| | | | |
|---|---|---|---|
| 3,219,747 | 11/1965 | McAdams | 219/10.55 D |
| 3,544,751 | 12/1970 | Valles | 219/10.55 D |
| 3,629,537 | 12/1971 | Haggensen | 219/10.55 D |
| 3,666,904 | 5/1972 | Krajewski | 219/10.55 D |
| 3,748,424 | 7/1973 | Fitzmayer | 219/10.55 D |
| 3,809,843 | 5/1974 | Takayama | 219/10.55 D |
| 3,854,022 | 12/1974 | Moore | 219/10.55 E |

*Primary Examiner*—Bruce A. Reynolds
*Attorney, Agent, or Firm*—Watson Leavenworth Kelton & Taggart

[57] ABSTRACT

There is disclosed a shield structure for utilization around the door seal of a microwave oven to deflect any microwave energy radiation leakage rearwardly of the unit so as to eliminate exposure hazard to a person using the oven.

8 Claims, 4 Drawing Figures

FIG. 1
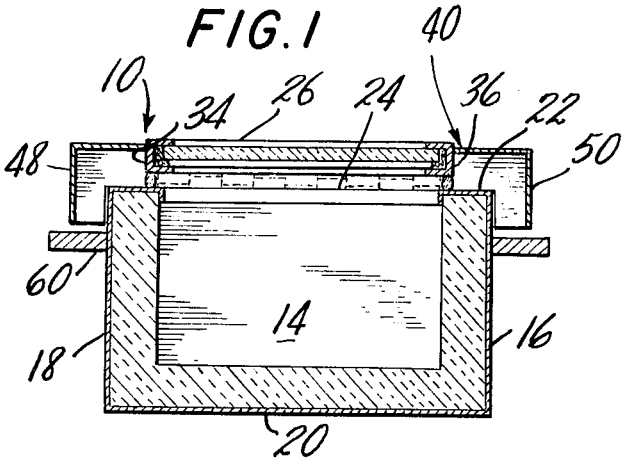
FIG. 2
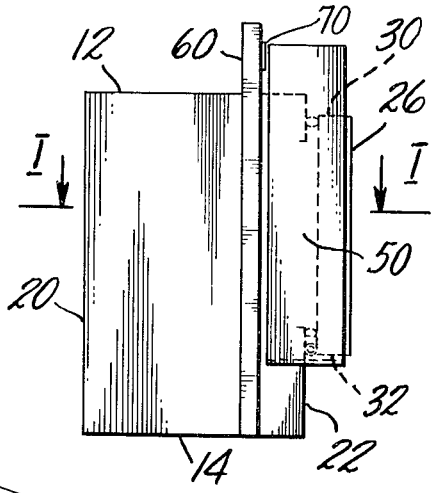
FIG. 3
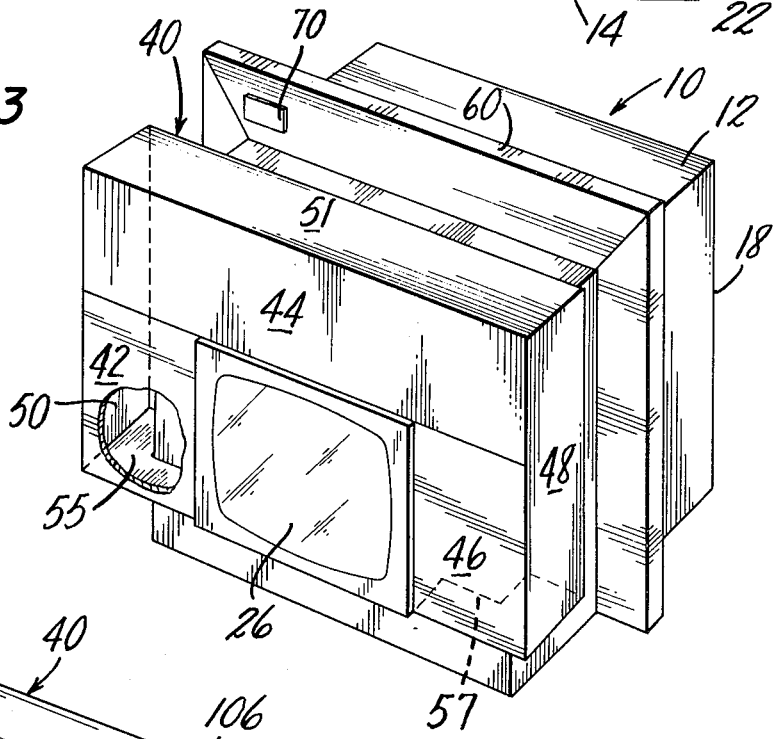
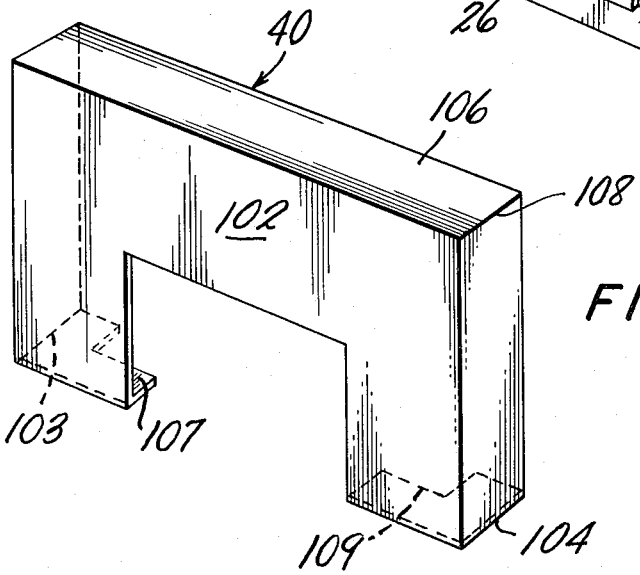
FIG. 4

MICROWAVE OVEN CONSTRUCTION

BACKGROUND OF THE INVENTION

The present invention is concerned with safety features for a microwave oven for the purpose of providing protection to users of such equipment in the event of microwave radiation leakage therefrom.

Microwave ovens are being used more and more extensively for various purposes, particularly for cooking foods in both the home and commercial establishments. The advantage of using these devices in connection with cooking food is the rapidity with which food can be cooked as well as the economical use of power as attends the operation of such devices. At the present time, microwave oven equipment has generally standardized construction particular to the extent that all such ovens operate at 2450 MHz. A problem incident to the use of such devices, is that it is possible for harmful microwave leakage (generally regarded as leakage of more than 10mw/cm$^2$) to escape thereupon and this can have serious consequences to the user. It is known to provide a microwave oven with an oven door seal to prevent radiation leakage from the oven space. One form of seal involves maintaining a good metal-to-metal contact between the oven frame and the door as by spring-loading the door and/or fixing a metal seal strip at the periphery of the oven opening. Other types of seal commonly used are the so-called "capacitive and choke" type. Notwithstanding the endeavor to provide optimum protection for the oven users, it is possible for radiation leakage to occur, e.g., due to dimished tension in the spring-loaded door device, as well as to the deposit of food or other non-conducting material on the mating metal surfaces of the door and adjacent periphery of the oven opening which prevent achievement of fully sealed closure of the door. Accordingly, it is possible that excessive and dangerous levels of leakage can occur while the oven is in operation. When the oven door is open, a safety switch is employed to cut off power to the unit so that no radiation problems will exist in such condition. But during operation, the user cannot under ordinary circumstances detect the presence of microwave leakage from the oven; it is quite possible for a person to be subjected to possibly harmful dosages of mirowave energy.

It, accordingly, is an object of the present invention to embody in microwave ovens means for deflecting any mirowave radiation leakage away from a user or bystander who is in the vicinity of the oven during operation of the same to thus eliminate such hazard as an incident of the use of the oven, and also for absorbing the deflected microwave radiation leakage and thus converting it to heat.

SUMMARY OF THE INVENTION

The present invention concerns the provision of means on a microwave oven to prevent any microwave radiation leakage therefrom causing harm to a user during the operation of the same. In accordance with the invention, the mirowave oven is provided with a shield structure fixedly carried on the door and encircling the edges of the door other than that by which said door is hinged to the oven, with the shield structure including a first portion or portions which extend generally parallel to the front wall of the oven to locations above the top of the oven (if the door is hinged at the bottom) and beyond the side walls of the oven housing. Additionally, a second portion or portions of the shield structure extend rearwardly of the front wall structure of the housing from the shield structure first portion for a predetermined distance alongside the oven side walls and top walls. The first and second portions of the shield structure are made as a single piece structure or can be of separate components connected together in a unitary construction to define a contiguous reflector for reflecting rearwardly of the housing front side any microwave energy radiation which may escape from the oven space at the periphery of the oven opening due to improper metal-to-metal contact between the door and oven opening surface. Thus, the reflector structure serves to deflect or reflect any radiation leakage rearwardly from the front of the oven and away from a person standing in the vicinity of the oven during its operation.

In accordance with the invention, the shield structure can be made from a suitable sheet metal member or members joined together in any convenient fashion as by shaping, and/or welding, and desirably is fitted to the edges of the oven door other than that edge with which the door is hinged to the oven housing. It is generally unnecessary to provide shield structure at the hinged end of the door since microwave ovens usually use a piano-type hinge which in itself functions to prevent any radiation leakage from passing through the opening along the expanse of the hinge. Aluminum and stainless steel are both satisfactorily employed for making the deflector.

In addition to the shield structure, the present invention provides that a collar of microwave radiaton-absorbent material be disposed around the outer periphery of the oven at a location intermediate the rear of the oven and the reflector structure. This radiation-absorbent material thus serves to absorb any rearwardly directed or reflected radiation and when used in conjunction with the shield structure reduces to almost zero the presence of radiation leakage in the vicinity of the oven. The absorbent material can be any of the materials well known as functioning as absorbents of mirowave radiation energy.

The invention additionally provides that the collar of absorbent material may include a telltale means for indicating the presence of microwave radiation flow to the absorbent material, since ordinarily a user is not able to detect that oven leakage is occurring. By using the telltale visual depiction of such occurrence, it is possible to warn the user to take necessary precautions in the operation of the oven as well as to ascertain if repair should be made to correct the leakage condition. The telltale can be in the form of a heat responsive material which undergoes a physical change, for example, a change of color or of state consequent with the heating of the absorbent material by microwave radiation.

The invention accordingly comprises the features of construction, combination of elements, and arrangements of parts, which will be exemplified in the construction hereinafter set forth and the scope of the invention will be indicated in the claims.

BRIEF DESCRIPTION OF THE DRAWING

A fuller understanding of the nature and objects of the invention will be had from the following detailed description taken in conjunction with the accompanying drawings in which:

FIG. 1 is a sectional view of a microwave oven provided with a shield in accordance with the principles of the present invention, as taken along the line I—I in FIG. 2.

FIG. 2 is an end elevational view of the oven depicted in FIG. 1.

FIG. 3 is a perspective view of the oven shown in FIGS. 1 and 2 depicting a shield construction in which the same is comprised of an assembly of substantially flat sheets.

FIG. 4 is a perspective view of a one piece shield structure.

Throughout the following description like reference numerals are used to denote like parts in the drawings.

DESCRIPTION OF THE PREFERRED EMBODIMENTS

Referring now to FIGS. 1–3, there is shown a microwave oven 10 which is of conventional construction and includes a housing comprised of a top wall 12, a bottom all 14, a pair of side walls 16 and 18, a rear wall 20, front wall structure 22, an opening 24 in the front wall structure, and a door 26 which when in closed position covers the opening 24. The aforementioned wall structure encloses an oven space in which can be received an article which is to be subjected to microwave energy, for example, a food item. As can be best noted in FIGS. 1 and 2, the door 26 for closing off opening 24 includes top and bottom edges 30 and 32 and side edges 34 and 36. While the door 26 is shown as being hinged at its bottom edge 32 to the bottom peripheral margin of the opening 24, it will be understood that the door could be hinged along any edge thereof. In such instance, and since piano-type shields are used in the connection of the door to the oven, it is not essential that the shield structure to be described shortly also extend along the hinged side of the door. Thus, while the description herein is given in terms of connecting the door along its bottom edge, if the same were instead to be placed along one of the side edges, the shield structure would be modified accordingly so that the same would extend along the top, bottom and other side edge of the door.

With particular reference now to FIG. 3, the shield structure 40 can include first portions 42, 44 and 46 which are preferably made of suitable sheet material such as aluminum or stainless steel, and are provided advantageously as planar extensions of the door 26 extending from the top and side edges of the door parallel to the front wall structure of the housing to locations above the top wall 12 of the housing and beyond the side walls 16, 18 of the housing. Additionally, there are provided portions 48 and 50 which extend rearwardly from the first portions 44, 46 and 42, 44, respectively, and a portion 51 extending from portion 44 for a predetermined distance alongside the side walls 16, 18 and top wall 12 of the housing, the said portions 40, 50 and 51 being disposed at an included angle with portions 42, 44, 46 not greater than a right angle. Further, L planar outline portions 55, 57 extend from the bottom of the shield structure alongside parts of the front wall and side walls of the oven to deflect any downward leakage as may exist, said portions 55, 57 along with portions 48, 50 and 51 hereinafter being collectively referred to as "second portions." Said portions 55, 57 extend rearwardly from the portions 46, 48 and 42, 50 adjacent the bottom of door 26 to confrontation with front wall 22 of the oven, and a distance alongside the opposite side walls 16, 18 in close fitting conformity with said walls. The said first and second portions of the shield structure thus define a contiguous reflector for reflecting rearwardly of the housing front side wall structure any microwave energy radiation which may escape from the oven space along the top and side marginal expanses of the opening during operation of the oven. As can be seen in FIGS. 1 and 2, the shield desirably extends beyond the sides and top of the oven housing to deflect radiation from a defective door seal past the front wall of the oven towards the rear.

In making the shield, as noted above, aluminum, stainless steel or other suitable metal can be used and the same can be provided from sheet members of a thickness which need only be sufficient to insure mechanical stability, i.e., to resist deformation during the life of the oven.

In accordance with the invention, it is also possible additionally to provide a collar of microwave radiation-absorbent material in an encircling course about the oven housing at a location intermediate the reflector structure 40 and the rear wall 20 of the housing. Thus, the collar 60 of absorbent material encircles the top end walls 16, 18 and top wall 12 of the oven and extends above and to the sides of the maximum expanse of the shield 40. Such radiation-absorbent materials are well known in the art and can comprise resinous foams, rubbers, and like, loaded with radiation-absorbents such as carbon or ceramic foams. Particularly useful are materials which contain barium titanate. Furthermore, these materials can be provided with holes or indented surfaces to facilitate faster cooling and lower thermal conductivity in the absorbent material. Particularly advantageous forms of materials are those of Emerson and Cumings, Inc., Microwave Products Division, Canton, Massachusetts 02021: "Eccosorb" ANP75 a loaded polyurethane foam, or "Eccosorb" HT closed cell ceramic foam material.

In accordance with the invention a telltale means can be provided to indicate the presence of microwave radiation leakage from the oven. Generally a user of the oven would not be aware of the fact that the oven is leaking mirowave energy. Accordingly, a telltale such as that shown at 70 in FIGS. 1 and 3 can be provided on the absorbent material collar 60. The telltale can be a material which undergoes physical change due to heating of the absorbent material. Thus, a heat responsive material which changes color can be affixed as by tape to the absorbent material so when the absorbent material absorbs heat due to radiation, the heat responsive material will undergo a change of color and the user will be able to visibly detect the fact that there is leakage. Such material may be comprised by silver colored tapes available commercially from Telatemp Corporation, P. O. Box 5160, Fullerton, California. Such tapes turn black permanently when heated to a predetermined temperature. Other types of materials including liquid crystals which change state at a predetermined temperature also can be used. Such liquid crystals are commercially available from Edmund Scientific Company, Barrington, New Jersey. It is further possible to relate the physical change characteristic in the telltale material to a particular level of radiation leakage.

FIG. 4 shows a slightly modified form of shield 40, in which the shield is made from a single sheet of aluminum or stainless steel. The sheet from which it is made includes a section 102 comprising the first or front portion of the shield, sections 103 and 104 constituting the sides of the shield and a section 106 constituting the top. Additionally, L planar outline sections 107, 109 are provided at the bottom of the shield. Sections 103, 104 and 106 are bent at an angle to the front section 102 in which the included angle between each respective section 103, 104 and 106 and the section 102 is 90° or less. If the enclosure structure depicted in FIG. 4 can be made in a single stamping operation the same would be quite satisfactory for formation of the structure. If, however, it is necessary to join the sections 103, 104 to the section 106, this could be done by welding as at 108 or the like.

Thus, it will be seen that the present invention provides a relatively inexpensive and convenient manner of constructing a microwave oven to insure that an incident of microwave radiation leakage will not have harmful effect to the user of the oven inasmuch as all such radiation will be deflected away from the front of the oven and when the oven embodies an absorbent material, be reduced to zero level.

What is claimed is:

1. A microwave oven comprising a housing enclosing a space for receiving an article to be heated with microwave energy, said housing including opposed top and bottom walls, a rear wall, a pair of side walls and front wall structure, said front wall structure having an opening therein and having top, bottom and side marginal expanses bordering said opening, and a generally flat door having a bottom edge hinged to said housing on the front wall structure adjacent the bottom marginal expanse of said front wall structure, said door having top and side marginal expanses abuttable respectively with said top and side marginal expanses of said front wall structure for closing said opening when said door is in closed position during operation of said oven, the improvement of shield structure fixedly supported by said door spacedly from such abutting marginal expanses of said door and said front wall structure when said door is in said closed position, said shield structure including a first portion extending generally parallel to the front wall structure of said housing to locations above the top wall of said housing and beyond the side walls of said housing, and a second portion extending rearwardly of the front wall structure of said housing from said first portion a predetermined distance alongside said housing side walls and top wall; said first and second portions being connected together in unitary structure to define a contiguous reflector for reflecting rearwardly of said housing front wall structure any microwave energy radiation which may escape from said abutting marginal expanses of said door and said front wall structure when said door is in said closed position, during operation of said oven.

2. The microwave oven of claim 1 in which said first portion is a planar sheet metal member, said second portion being planar and connected to said first portion in a disposition in which the included angle therebetween is not more than 90°.

3. The microwave oven of claim 2 in which said members are aluminum.

4. The microwave oven of claim 2 in which said members are stainless steel.

5. The microwave oven of claim 1 further comprising a collar of microwave radiation-absorbent material extending around the top wall and side walls of said housing at a location intermediate the rear wall of said housing and said reflector structure.

6. The microwave oven of claim 5 in which said collar of absorbent material further comprises telltale means for indicating the presence of microwave radiation flow to said absorbent material.

7. The microwave oven of claim 6 in which said telltale means is a heat responsive material which undergoes physical change consequent with heating of said absorbent material by microwave radiation.

8. The microwave oven of claim 1 wherein said second portion further includes structure of an L planar outline extending rearwardly from said first portion adjacent the bottom of said door to confrontation with the front of said oven, and, a distance alongside the opposite side walls of said oven for deflecting any radiation escaping downwardly from said opening.

* * * * *